US006396012B1

(12) United States Patent
Bloomfield

(10) Patent No.: US 6,396,012 B1
(45) Date of Patent: May 28, 2002

(54) ATTITUDE SENSING ELECTRICAL SWITCH

(76) Inventor: Rodger E. Bloomfield, 4120 Lahring Rd., Linden, MI (US) 48451

( * ) Notice: Subject to any disclaimer, the term of this patent is extended or adjusted under 35 U.S.C. 154(b) by 0 days.

(21) Appl. No.: 09/332,750

(22) Filed: Jun. 14, 1999

(51) Int. Cl.[7] ..... H01H 29/06
(52) U.S. Cl. ..... 200/233; 200/152
(58) Field of Search ..... 200/220, 233, 200/262, 263

(56) References Cited

U.S. PATENT DOCUMENTS

| | | | | | |
|---|---|---|---|---|---|
| 1,993,046 | A | * | 3/1935 | Warnke | 200/152 |
| 1,993,045 | A | * | 5/1935 | Warnke | 200/152 |
| 3,462,573 | A | * | 8/1969 | Rabinowitz et al. | 200/152 |
| 3,836,739 | A | | 9/1974 | Endo | 200/61.45 |
| 4,628,160 | A | | 12/1986 | Canevari | 200/61.45 |
| 4,797,519 | A | * | 1/1989 | Elenbaas | 200/226 |
| 4,820,888 | A | | 4/1989 | Shields | 200/61.45 |
| 5,256,839 | A | | 10/1993 | Gallagher | 200/61.52 |
| 5,543,767 | A | | 8/1996 | Elenbaas | 335/205 |
| 5,669,147 | A | * | 9/1997 | Nakajima et al. | 33/334 |

FOREIGN PATENT DOCUMENTS

| | | | |
|---|---|---|---|
| JP | 409129099 | A | * 5/1997 |
| JP | 409304061 | A | * 11/1997 |

* cited by examiner

*Primary Examiner*—Paula Bradley
*Assistant Examiner*—Nhung Nguyen

(57) ABSTRACT

An attitude sensing electrical switch uses an electrically conductive powder as the switching medium. The powder has a particle size and shape that enables it to flow smoothly into and out of contact with electrical terminals mounted in the switch. Silver, gold, and copper powders with a particle size between one-hundred-forty and three-hundred microns perform effectively.

12 Claims, 2 Drawing Sheets

ATTITUDE SENSING ELECTRICAL SWITCH

BACKGROUND OF THE INVENTION

1. Field of the Invention

This invention provides an attitude sensing electrical switch that uses environmentally safe powders as a switching medium.

2. Brief Description of the Prior Art

Attitude sensing or tilt switches are used widely in automotive applications and home equipment to complete an electrical circuit when the switch is moved into a predefined attitude. The switches are used extensively in automobiles to turn on trunk lights and underhood lights when access doors to those spaces are opened. An attitude sensing switch also is used in many home thermostats to complete or interrupt electrical circuits that control heating or cooling equipment when a bimetal device moves the switch in response to temperature changes.

Most attitude sensing switches use mercury as the switch medium. Mercury is a liquid at all temperatures reasonably encountered by automobiles and trucks and within homes, and it is a ready conductor of electricity. The auto industry uses nearly ten tons of mercury each year in attitude sensing switches.

Mercury is a naturally occurring mineral that does not degrade and is not destroyed by combustion. When released in vapor form to the atmosphere, mercury is redeposited on land and water surfaces where a portion is converted into methylmercury. This compound accumulates in aquatic organisms, enters the food chain, and eventually is ingested by humans. It has toxic effects on living systems and has been found to be a neurotoxin that can damage the central nervous system of humans.

Efforts to reduce the emissions of mercury are underway on a number of fronts. Waste containing mercury is classified as hazardous under the Resource Conservation and Recovery Act and is subject to careful disposal controls. Whether these controls will be adequate to protect human health remains to be seen, and efforts to reduce the uses of mercury are underway on several fronts.

SUMMARY OF THE INVENTION

This invention provides an attitude sensing electrical switch that uses electrically conducting powder as the switching medium in place of mercury. The switch comprises a housing made of an electrically conductive or an electrically insulating housing material. An electrically conducting powder is movably located inside said housing. With a housing made of an electrically conductive material, an electrical terminal extends into the housing and is electrically insulated from the housing. When the housing is tilted into a first attitude, the conductive powder moves into a position where it provides an electrical connection between the housing and the electrical terminal. The powder moves into another position where it interrupts the electrical connection between the housing and the terminal when the housing is tilted into a second attitude.

The electrically conductive housing can be made of brass, aluminum, copper, or other materials. The housing preferably is cylindrical and the electrical terminal is located in a plug made of an electrically insulating material that closes one end of the housing. The housing can be made by a stamping process so that the other end is closed and smoothly rounded.

Conductive powders with low electrical resistance and good flowing characteristics are preferred. Silver, gold, copper, beryllium, rhodium, iridium, and tungsten powders with particle sizes of seventy-five to three hundred microns perform effectively. Powders with larger particle sizes of one-hundred-forty to three hundred microns generally have better flowing characteristics and are preferred. Filling the empty space of the housing with an inert gas such as argon or nitrogen helps extend the useful life of the switch.

In the alternative structure in which the housing is nonconductive material, two electrical terminals extend into the interior of the housing and a quantity of an electrically conducting powder is movably located inside said housing. In the manner described above, tilting the housing into a first attitude enables the conductive powder to flow into a position where it provides an electrical connection between the two electrical terminals. Tilting the housing into another position enables the powder to flow into a second attitude where it interrupts the electrical connection between the terminals.

The nonconductive material for the housing can be tubing made of glass or a non-sticking polymeric material such as polyamide or polyfluorcarbon. Several different structures can be designed to utilize the invention. Both terminals can be embedded in the cylindrical wall of the housing, both terminals can be included in plugs that close the ends of the housing, or a combination of these can be used.

BRIEF DESCRIPTION OF THE DRAWINGS

FIG. 1 shows the housing rotated clockwise into an attitude where the powder has flowed to an end of the housing where it does not complete an electrical circuit.

FIG. 2 shows the switch of FIG. 1 when the housing is rotated counterclockwise into an attitude where the powder has flowed into contact with the electrical terminal installed at the end of the housing and is in contact with the housing. The powder accordingly completes the electrical circuit.

FIG. 3 shows the housing rotated into an attitude where the powder does not contact both electrical terminals and does not complete an electrical circuit. FIG. 4 shows the housing rotated into an attitude where the powder has flowed into contact with both electrical terminals and completes an electrical circuit.

DESCRIPTION OF THE PREFERRED EMBODIMENT

Figure 1:
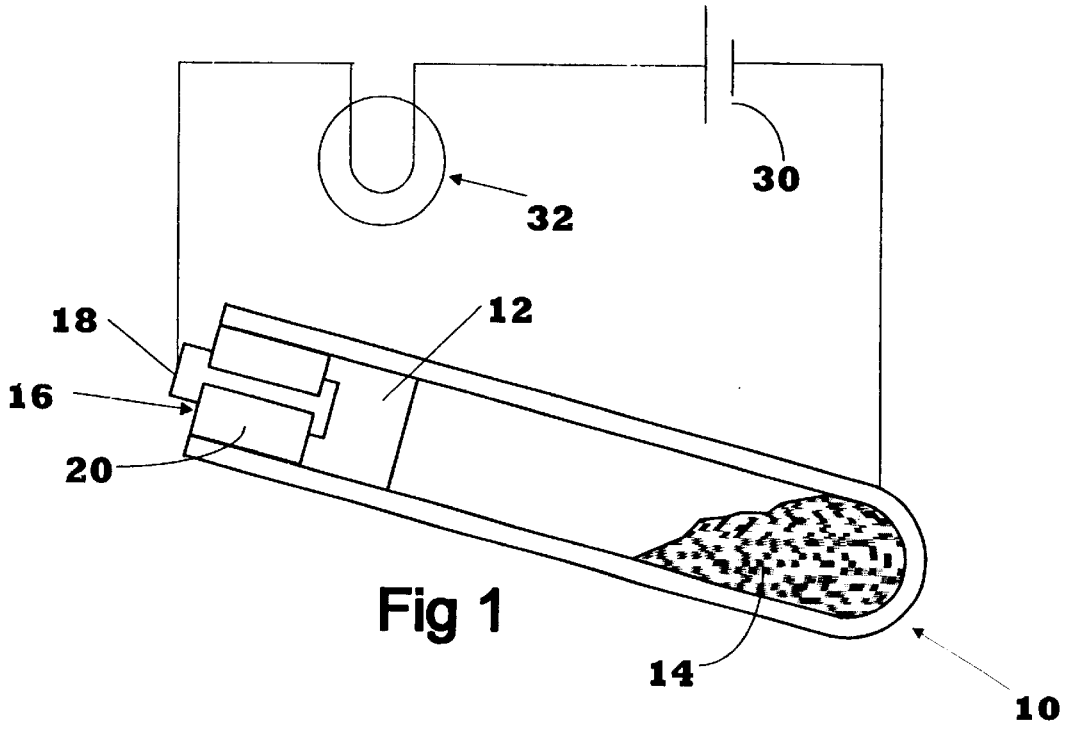
FIGS. 1 and 2 show an electrical switch of the invention in which the housing is made of an electrically conductive material.
Figure 2:
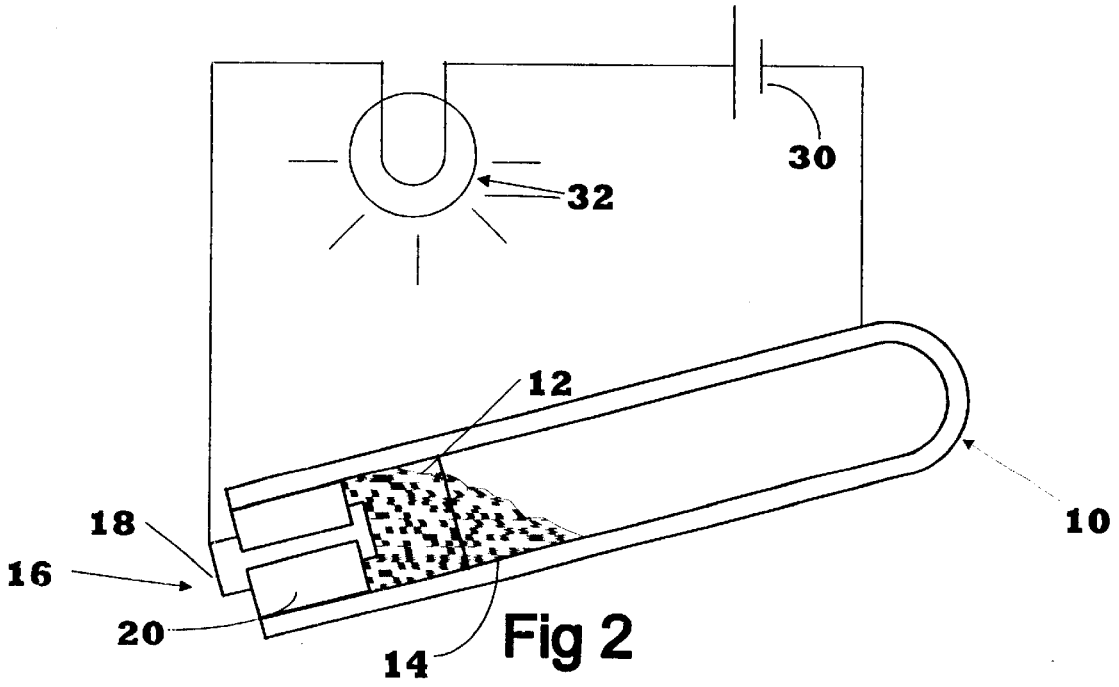

Referring to FIGS. 1 and 2, a cylindrical housing 10 is closed and rounded smoothly at one end. Housing 10 is made of an electrically conductive material such as brass. A coating 12 of an electrically insulating and non-sticking material such as paint or a polyfluorocarbon is applied to a portion of the housing interior near the open end.

A small amount of an electrically conducting powder 14 is placed in housing 10 and a terminal assembly 16 is installed in the open end of the housing. Terminal assembly 16 consists of an electrical terminal 18 that is installed in an electrically insulating seal 20. The seal material fits snugly in the end of housing 10 to contain powder 14 within the housing.

An electrical circuit consisting of a power source 30 and an electrical device 32 is connected electrically to terminal 18 and housing 10. With housing 10 in the attitude shown in FIG. 1, powder 14 contacts the housing itself but is not in contact with terminal 18. Tilting housing 10 into the attitude shown in FIG. 2 enables powder 14 to slide into the position shown in the Figure where it contacts both housing 10 and terminal 18 and completes an electrical circuit between the housing and the terminal.

In a typical automotive application, the power source is the vehicle battery and the electrical device is an underhood lightbulb. Housing 10 is attached to the vehicle hood so that when the hood is closed, the housing is in the attitude illustrated in FIG. 1 in which powder 14 is primarily in the closed end of the housing and does not contact both the housing and terminal 18.

Opening the hood moves housing 10 into the attitude shown in FIG. 2 in which powder 14 flows into contact with both the housing and terminal 18. This completes the electrical circuit and illuminates the underhood lightbulb represented by electrical device 32.

Powder 14 can be any material with low electrical resistivity and an ability to flow readily down a tilted surface. Metallic materials such as silver, gold, and copper powders with particle sizes of one-hundred-forty to three-hundred microns perform effectively. Powders that have a flake-like shape work effectively by sliding from one position to another within the housing, while powders with a spherical shape tend to roll and can move into and out of the desired position with reduced overall switch tilting. Silver particles that have been produced by atomization generally approach a spherical shape, have smooth surfaces, and are preferred.

A useful switch construction consists of a brass tube 38 mm long with an inside diameter of 8 mm. The interior of the tube is plated with a thin plating of tin and burnished to enhance the flowing of the powder. Coating 12 is applied to the initial 10 mm of the open end of the tube and terminal assembly 16 extends into the tube for three millimeters. The coating helps prevent bridging that can occur with some powders when the particles stick together to form a chain of powder between terminal 18 and housing 10. The housing contains one-half gram of silver powder having a particle size of one-hundred-forty microns.

Figure 3:
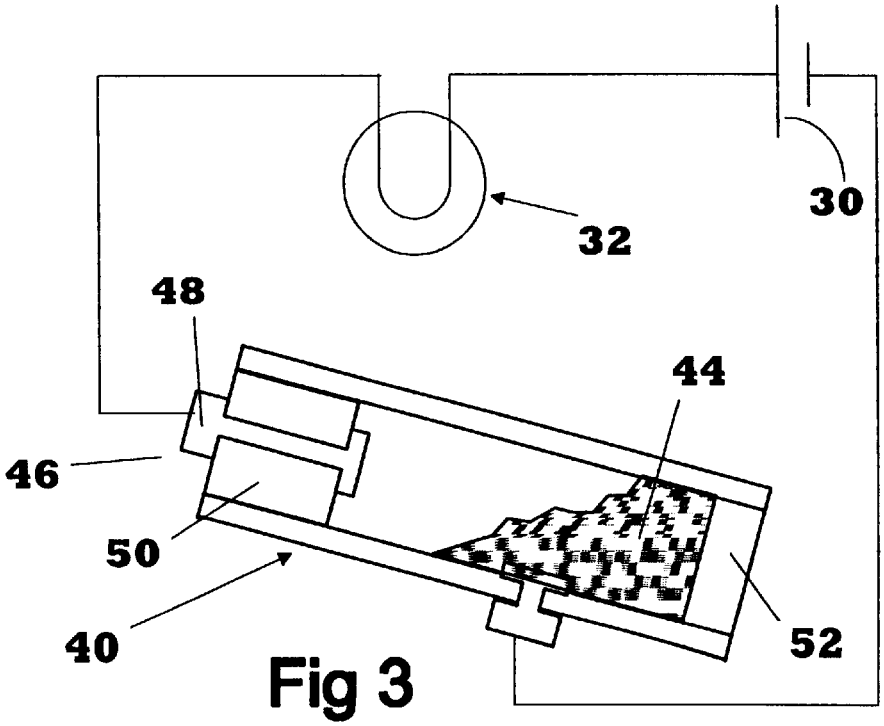
FIGS. 3 and 4 show an alternative construction in which the housing is an electrically insulating material and one of the terminals is installed in the cylindrical wall of the housing.

Referring to the alternate construction of FIG. 3, housing 40 is made of a tube of non-conducting material such as polyamide (nylon), polyfluorcarbon, or glass. A small amount of a conducting powder 44 is placed in the housing and a terminal assembly 46 is installed in the open end of the housing. Terminal assembly 46 consists of an electrical terminal 48 that is installed in a seal 50. Another seal 52 is installed in the other end of housing 40. Seals 50 and 52 fit snugly in the ends of housing 40 to contain powder 44 within the housing.

An electrical terminal 54 is embedded in the cylindrical wall of housing 40 and extends into the interior of the housing. Similarly to the construction of FIGS. 1 and 2, an electrical circuit consisting of a power source 30 and an electrical device 32 is connected electrically to terminals 48 and 54. In a typical automotive application, the power source is the vehicle battery and the electrical device is an underhood lightbulb.

Figure 4:
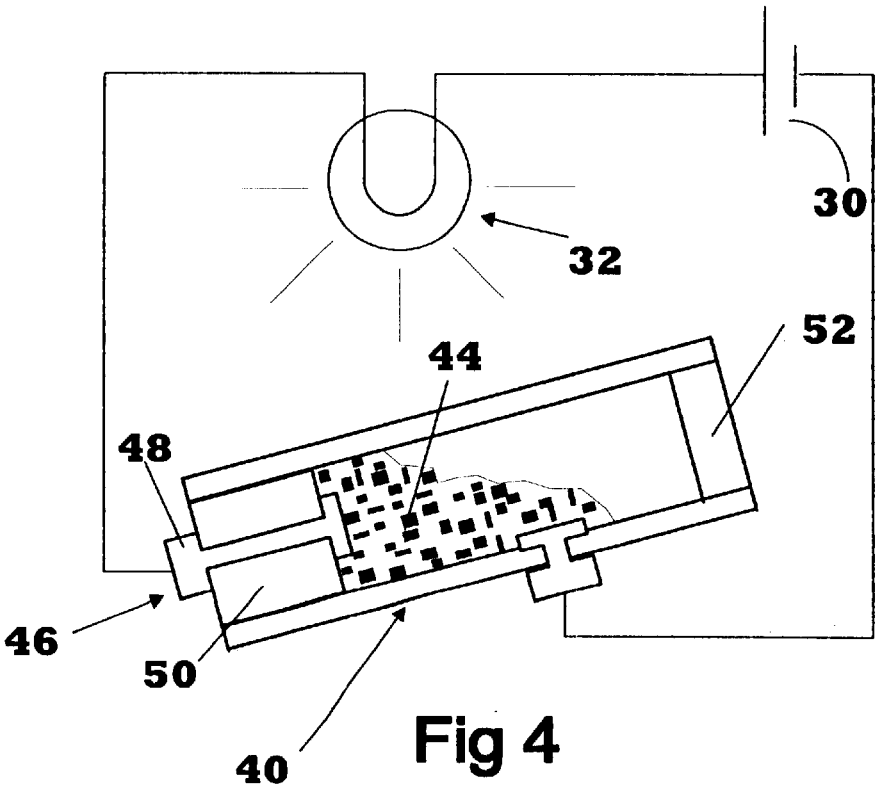

Terminal 54 is positioned so that tilting housing 40 through a desired range moves powder 44 into and out of electrical contact with both terminal 48 and terminal 54, as illustrated by FIGS. 3 and 4. In a typical installation, housing 40 is installed so terminal 54 is on the bottom of the housing as shown in the drawings. In some situations it is desirable to install terminal 54 in the upper surface of housing 40 and closely adjacent terminal 46 so that tilting housing 40 into a nearly vertical attitude produces an electrical connection and tilting it toward horizontal interrupts the electrical connection.

Mercury and its compounds also are used in many other products including batteries, fluorescent lights, and some plastic parts. Using switches of this invention in place of mercury-containing switches will not eliminate emissions of mercury and its compounds into the environment, but will achieve a meaningful reduction. Switches of this invention also exhibit greatly reduced bouncing effects, which sometimes are exhibited by mercury switches. Bouncing produces intermittent connection and disconnection that can be detrimental to electronic circuits.

I claim:

1. An attitude sensing electrical switch comprising an electrically conductive housing, an electrical terminal located inside said housing and electrically insulated from the housing, and an electrically conducting powder movably located inside said housing, said powder moving into a position where it provides an electrical connection between the housing and the electrical terminal when the housing is tilted into a first attitude, said powder moving into another position where it does not provide an electrical connection between the housing and the terminal when the housing is tilted into a second attitude, said powder having a particle size of seventy-five to three hundred microns.

2. The switch of claim 1 in which the powder is selected from the group of silver, gold, and copper.

3. The switch of claim 2 in which the powder is silver and the particles of the powder have a spherical shape.

4. The switch of claim 3 in which the interior surface of the housing has an electrically insulating coating adjacent the terminal.

5. The switch of claim 1 in which the powder is silver and the particles of the powder have a spherical shape.

6. The switch of claim 1 in which the interior surface of the housing has an electrically insulating coating adjacent the terminal.

7. An attitude sensing electrical switch comprising an electrically insulated housing, electrical terminals located within said housing, and an electrically conducting powder movably located inside said housing, said powder moving into a position where it provides an electrical connection between said electrical terminals when the housing is tilted into a first attitude, said powder moving into another position where it does not provide an electrical connection between said terminals when the housing is tilted into a second attitude, said powder having a particle size of seventy-five to three hundred microns.

8. The switch of claim 7 in which the powder is selected from the group of silver, gold, and copper.

9. The switch of claim 8 in which the powder is silver and the particles of the powder have a spherical shape.

10. The switch of claim 9 in which the powder has a particle size of one-hundred-forty to three-hundred microns.

11. The switch of claim 7 in which the particles of the powder have a spherical shape.

12. The switch of claim 7 in which the powder has a particle size of one-hundred-forty to three-hundred microns.

* * * * *